US005165855A

United States Patent [19]

Ricketts et al.

[11] Patent Number: 5,165,855

[45] Date of Patent: Nov. 24, 1992

[54] TRANSVERSE BLOWER FAN AND METHOD OF ASSEMBLY

[75] Inventors: Jon E. Ricketts, Viola; Robert A. Matousek, Minooka, both of Ill.; Kenneth Robitaille, Bad Axe, Mich.

[73] Assignee: Case Corporation, Racine, Wis.

[21] Appl. No.: 720,715

[22] Filed: Jun. 25, 1991

[51] Int. Cl.[5] ..... B63H 1/26

[52] U.S. Cl. ..... 416/178; 416/187; 416/214 R

[58] Field of Search ..... 416/178, 187, 185, 214 R

[56] References Cited

U.S. PATENT DOCUMENTS

| | | | |
|---|---|---|---|
| 875,550 | 12/1907 | McCorkell . | |
| 973,241 | 10/1910 | Vestal et al. . | |
| 2,115,367 | 4/1938 | Levy et al. . | |
| 2,421,254 | 5/1947 | Froelich . | |
| 2,987,172 | 6/1961 | Linsenmeyer . | |
| 3,156,408 | 11/1964 | Whitenack, Jr. | 416/187 |
| 3,181,778 | 5/1965 | Mayne . | |
| 3,257,070 | 6/1966 | Kuklinski . | |
| 3,262,637 | 7/1966 | Sprouse et al. . | |
| 3,469,773 | 9/1969 | Pool et al. . | |
| 3,635,588 | 1/1972 | Lester et al. | 416/187 |
| 3,664,349 | 5/1972 | Quick . | |
| 3,694,881 | 10/1972 | Gluckman . | |
| 3,813,184 | 5/1974 | Temple et al. . | |
| 3,816,023 | 6/1974 | Shaver . | |
| 4,436,484 | 3/1984 | Temple et al. . | |

FOREIGN PATENT DOCUMENTS

| | | | |
|---|---|---|---|
| 2517528 | 11/1976 | Fed. Rep. of Germany | 416/178 |
| 2732680 | 2/1979 | Fed. Rep. of Germany | 416/178 |
| 0071709 | 6/1977 | Japan | 416/178 |
| 0085593 | 7/1981 | Japan | 416/178 |
| 0046094 | 3/1982 | Japan | 416/178 |

*Primary Examiner*—Thomas E. Denion

*Attorney, Agent, or Firm*—Dressler, Goldsmith, Shore, Sutker & Milnamow, Ltd.

[57] ABSTRACT

A transverse fan assembly including a plurality of elongated fan blades arranged in a cylindrical array and a plurality of axially spaced and generally aligned discs of substantially uniform diameter. Each disc defines equidistantly spaced slots concentric with and inwardly of the disc periphery for allowing the blades to loosely pass therethrough. Each blade is individually attached to a disc by a blade retainer which, in response to an individual twisting action upon the blade, releasably and individually attaches the blade to the disc under a substantially constant and independent force in a manner allowing for removal or replacement of the blade without affecting other blades in the fan assembly.

15 Claims, 3 Drawing Sheets

TRANSVERSE BLOWER FAN AND METHOD OF ASSEMBLY

FIELD OF THE INVENTION

The present invention generally relates to transverse blower fan assemblies and, more particularly, to a simplified fan structure allowing for individual replacement of fan blades when required without effecting other blades of the fan assembly and without requiring use of tools and the like. A method of assembling the fan structure is also disclosed.

BACKGROUND OF THE INVENTION

Transverse fan assemblies are well known in the art for their unique ability to produce a wide and generally uniform air stream. Transverse fan assemblies typically include axially spaced disc-like members which support a plurality of parallel and elongated fan blades in a cylindrical array. As many as thirty-six fan blades may be arranged in the cylindrical array.

It is common to attach the fan blades to the supporting discs by riveting or welding processes. As will be appreciated, individually riveting one end of a series of blades to a disc and then repeating the riveting process at an opposite fan blade end is a time consuming process which is difficult to automate. In addition to the significant time involved in individually welding the fan blades to the discs, the unavoidable heat effects of a welding process often causes distortion or warpage of the fan blades.

When the fan assembly is used in combination with agricultural equipment, such as combines and the like, the fan blades may encounter rocks and other damaging debris during operation of the equipment. The fan assembly is normally operated at relatively high speeds and the rocks and other debris encountered by the fan blades can and often do bend and/or break the blades. As will be appreciated, broken and/or bent fan blades effect fan performance and overall efficiency of the machine. In addition to the other drawbacks mentioned above, riveting or welding of the fan blades to the disc inhibits individual replacement of the blades. Eventually, the entire fan assembly requires replacement. Replacement of the fan assembly is, of course, a time consuming and costly process.

U.S. Pat. No. 3,816,023 to J. Lyle Shaver discloses a blower wheel wherein one fastening device attaches all the fan blades to a support disc. The fastening device is in the form of an internal retaining ring which wedges against an inner end of all the blades. The retaining ring releasably fits into a locking notch provided on each blade to inhibit the fan blades from axial displacement. To effect fan blade replacement, the retaining ring is radially compressed. Radial compression of the retaining ring removes the ring from the locking notch in a respective fan blade and, thus, permits replacement of the blade.

As will be appreciated, radial compression of the ring likewise removes the retaining ring from engagement with the majority if not all the other fan blades. Accordingly, great care must be taken to assure that the retaining ring is repositioned into each fan blade notch of all the other fan blades of the fan assembly upon replacement of a single fan blade. When as many as thirty-six or more fan blades are arranged in a cylindrical array, it is not difficult to appreciate that a considerable amount of time is involved in replacing a single fan blade with such a proposed design. Moreover, should the suggested retaining ring break during fan operation, all the fan blades will be effected possibly resulting in extended damage to the fan assembly.

Thus, there is a need and a desire for a transverse blower fan assembly which allows for individual fan blade replacement when required and in a minimum amount of time without effecting other blades and without requiring use of special tools and the like.

SUMMARY OF THE INVENTION

In view of the above, and in accordance with the present invention, there is provided a transverse blower fan assembly including a plurality of elongated fan blades extending axially in a cylindrical pattern and a plurality of axially and generally aligned discs which are attached to rotatable means. The discs are of generally uniform diameter and each disc defines equidistantly spaced slots arranged concentric with and inward of the periphery of the disc for allowing a fan blade to loosely pass therethrough. Each fan blade is individually attached to a disc by a blade retainer which, in response to an individual blade twisting action, applies an independent and generally constant force against an independent fan blade.

Preferably, the discs are secured for rotation about an elongated axis defined by an axially elongated central hub. The discs are secured in axially spaced relation relative to each other and include a pair of discs arranged toward opposite ends of the blades and a center disc arranged proximate to the middle of the blades. Moreover, each disc is preferably molded from a non-metallic material.

The equally spaced slots in the disc correspond in number to the number of fan blades arranged in the cylindrical array. In a preferred form of the invention, each fan blade has an arcuate configuration, and each slot has an arcuate surface complimentary to the blade. Each blade receiving slot in a disc defines first and second terminal ends which are disposed in a radially spaced relation relative to each other.

The retainer for individually attaching a fan blade to a disc includes a deflectable arm for independently and resiliently urging a respective blade against the terminal end of the slot under a substantially constant pressure thereby releasably holding the blade in position relative to a respective disc. Each deflectable arm preferably extends from one terminal end of each slot toward the opposite terminal end and is responsive to a twisting action being applied to the blade thereby releasably entraps a respective blade between the arm and the terminal end of the slot. In one form of the invention, each deflectable arm has a cantilevered configuration and is formed as an integral part of the disc. Accordingly, the deflectable arm does not normally become separated or lost from the disc, and the inventory of parts for assembling the fan is reduced.

Each fan blade is restrained against axial displacement relative to a disc of the fan assembly. In a preferred form, each fan blade includes recesses provided on opposite elongated edges of the blade. When the fan blade is releasably secured in place, registry is obtained between the recess and a respective disc. In an alternative version, each fan blade may be configured with laterally spaced ridges projecting from an arcuate face of the blade and which abut opposite sides of the disc to inhibit axial displacement of the blade relative to a disc.

Another aspect of the present invention relates to a method of assembling a transverse blower fan. The preferred method comprises the steps of: securing a plurality of discs to an elongated shaft in axially spaced relation to each other such that each slot of a multiplicity of circumferentially and equally spaced slots in the discs are axially aligned relative to each other; providing blade retaining means proximate to a terminal end of each individual slot, with the blade retaining means extending generally toward a second terminal end of a respective slot; inserting an elongated blade through the aligned slots in the disc; and twisting each blade within a respective slot until the blade is releasably and individually entrapped between said blade retaining means and a second terminal end of the slot under the influence of a substantially constant force individually directed against the blade by the blade retaining means.

The present invention provides a transverse blower fan assembly which is comprised of a minimum number of different parts. A unique aspect of the present invention concerns the ability to assemble a fan and/or effect individual blade replacement without the use of special tools and in a minimal amount of time. The fan blades are readily replaceable when required and are individually secured to the discs to facilitate replacement without effecting other blades of the fan assembly. The blades are releasably secured in place under the influence of a constant force applied to an individual blade such that if any blade retainer breaks or is significantly damaged, the remaining blades in the fan assembly are not effected, and the fan assembly continues to operate to maximize fan efficiency and effectiveness.

Numerous other features and advantages of the present invention will become readily apparent from the following detailed description, the accompanying drawings, and the appended claims.

BRIEF DESCRIPTION OF THE PRESENT INVENTION

Figure 1:
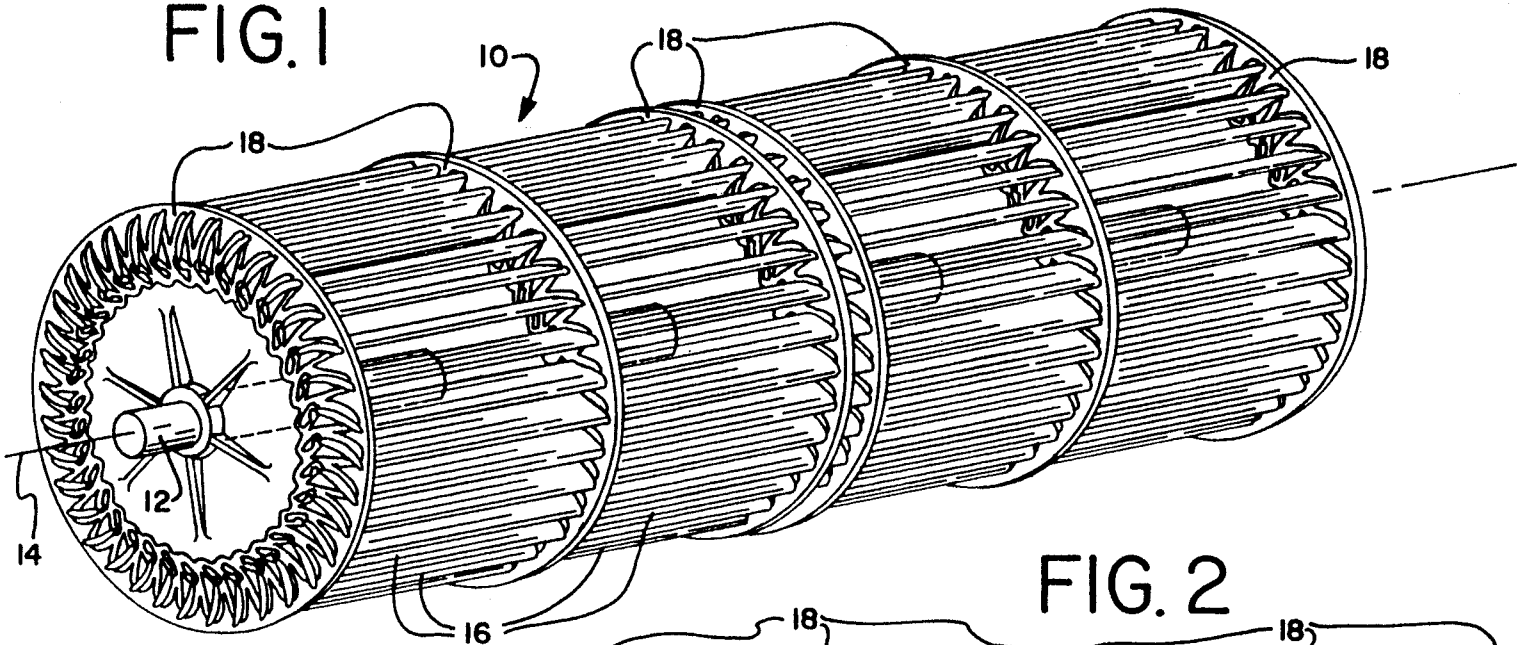
FIG. 1 is a perspective view of a transverse blower fan assembly according to the present invention.

While the present invention is susceptible of embodiment in various forms, there is shown in the drawings presently preferred embodiments of the invention which are hereinafter described, with the understanding that the present disclosure is to be considered as exemplifications of the invention, which are not intended to limit the invention to the specific embodiments illustrated.

Figure 2:
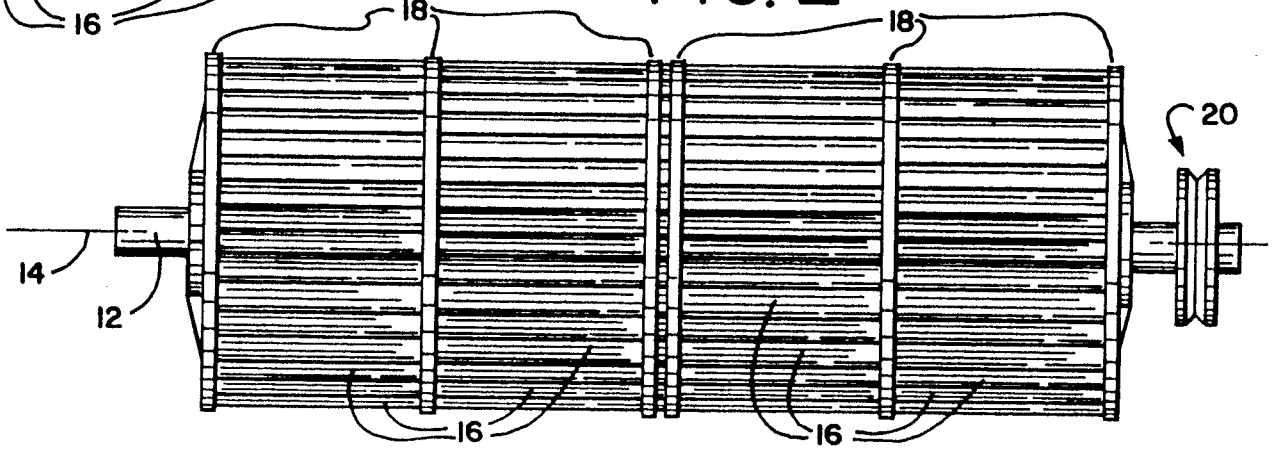
FIG. 2 is a front elevational view of the transverse blower fan assembly of the present invention.

Referring now to the drawings, wherein like reference numerals indicate like parts throughout the several views, there is shown in FIGS. 1 and 2 a transverse blower fan assembly 10. Fan assembly 10 includes a central axially elongated hub 12 defining an elongated axis of rotation 14 for the fan assembly, a plurality of fan blades 16 extend axially in a circumferential array or pattern about the hub 12, and a plurality of axially spaced and aligned discs 18. The fan assembly 10 can be driven through rotatable power means 20 connected to a suitable source of power (not shown).

In a preferred form of the invention, each fan blade 16 is fabricated from material such as sheet metal.

As shown in FIG. 2, discs 18 are of substantially uniform diameter. A pair of discs are arranged toward opposite ends of the fan blades, and one or more discs are arranged proximate midlength of the fan blades 16. Since the length of the transverse blower fan 10 is functionally unlimited, other discs may be provided along the length of the fan to counteract centrifugal forces acting on the blades 16 during operation of the fan assembly.

Figure 3:
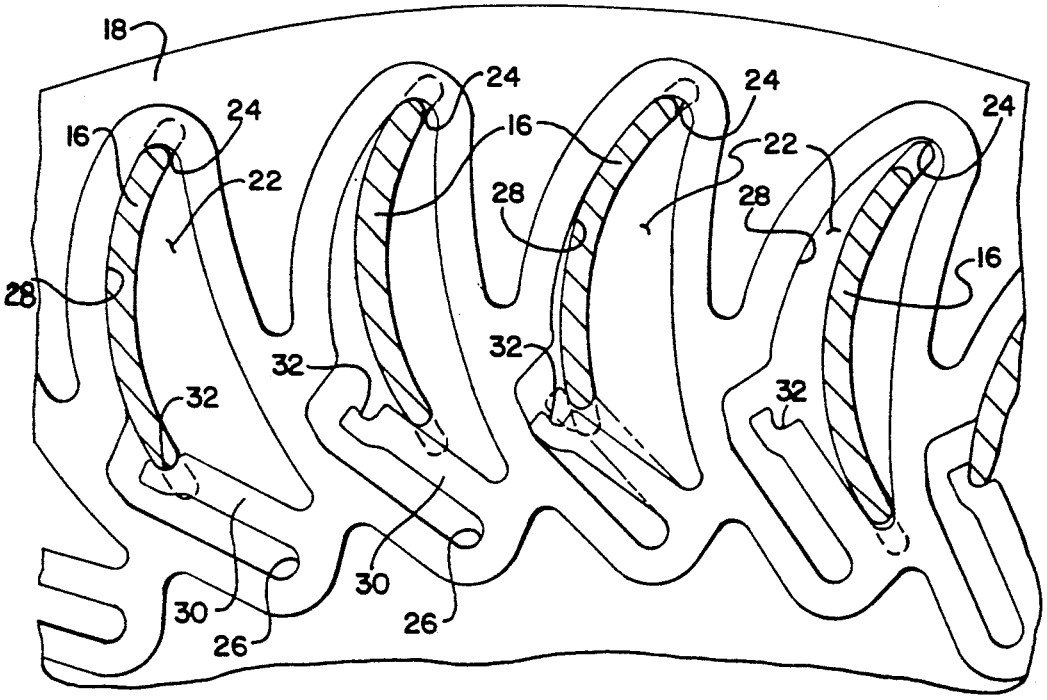
FIG. 3 is an enlarged fragmentary end view showing fan blades, illustrated in cross section, in different stages of releasable securement.

Turning to FIG. 3, each disc 18 defines a multiplicity of identical equidistantly spaced fan blade mounting slots 22. The slots 22 preferably correspond in number to the number of fan blades 16 comprising the fan assembly 10. The slots 22 are arranged concentric with and inwardly of the disc periphery. As shown, each slot 22 has a closed configuration sized to allow a fan blade 16 to loosely pass therethrough and with radially spaced terminal ends 24 and 26. The generally arcuate shape of each slot 22 includes a curved side surface 28 which generally corresponds to the arcuate shape of each fan blade and counteracts the centrifugal forces acting on each blade upon fan rotation.

Each blade 16 is independently and releasably secured to a disc by blade retaining means responsive to an independent twisting action on a fan blade within its respective slot 22. In the illustrated form of the invention, the blade retaining means comprises a deflectable arm 30 which projects into each fan blade mounting slot 22. Preferably, each disc is molded from a non-metallic material, and each deflecting arm 30 is integrally molded or formed with the disc 18. As shown, each arm 30 has a cantilevered configuration and extends from terminal end 26 toward terminal end 24 of slot 22. Toward its free end, each arm 30 is provided with a blade retaining notch 32 for releasably entrapping a radial inner edge of a respective fan blade 16 therewithin.

As will be appreciated, the radial distance separating the non-deflected position of notch 32 from terminal end 24 of slot 22 is sized to individually apply a substantially constant radially directed force against the respective blade 16 thereby moving the fan blade against the terminal end 24 of a respective slot in a manner releasably holding the blade in position for operation. As shown, each slot 22 is widened in the area of and for a distance substantially equal to the length of arm 30 to provide for adequate deflection of the arm 30 in response to a twisting action of a blade 16 within the slot 22.

Figure 4:
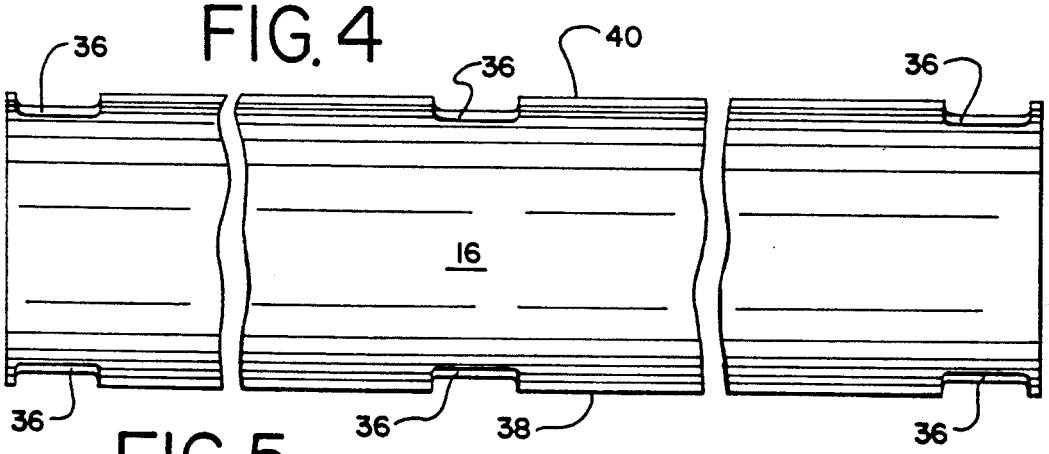
FIG. 4 is an enlarged fragmentary elevational view of a preferred form of a fan blade.
Figure 5:
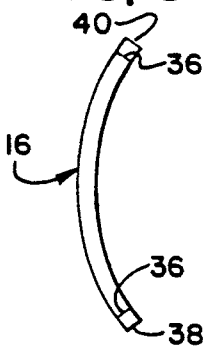
FIG. 5 is an end view of the fan blade illustrated in FIG. 4.
Figure 6:
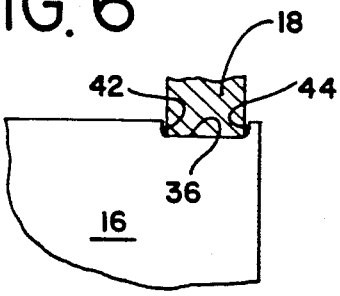
FIG. 6 is a fragmentary elevational view of an end portion of the fan blade illustrated in FIG. 4.

Fan assembly 10 further includes means for restraining each fan blade against axial displacement relative to the disc 18 during normal fan operation. Turning to FIGS. 4, 5 and 6, each blade 16 is provided with a series of relatively shallow recesses 36 arranged in axially spaced relation along opposite elongated edges 38 and 40. The number and axial spacing between the recesses 36 correspond to the number and axial spacing between discs 18.

Turning to FIG. 6, each recess 36 defines opposed abutment surfaces 42 and 44 which are axially spaced apart by a distance slightly greater than the thickness of a disc 18. Thus, when the blade is releasably secured to the disc 18, registry is obtained between the recess 36 and disc 18.

In an alternative form of the invention, each blade 16 may be cast or molded from a non-metallic material such as plastic or the like. As in the first embodiment, each non-metallic blade preferably has a generally arcuate cross-sectional configuration and includes means for restraining the blade against axial displacement relative to a disc during operation of the fan assembly. Such restraining means may be in the form of recesses 36 substantially similar to that discussed above.

Figure 7:
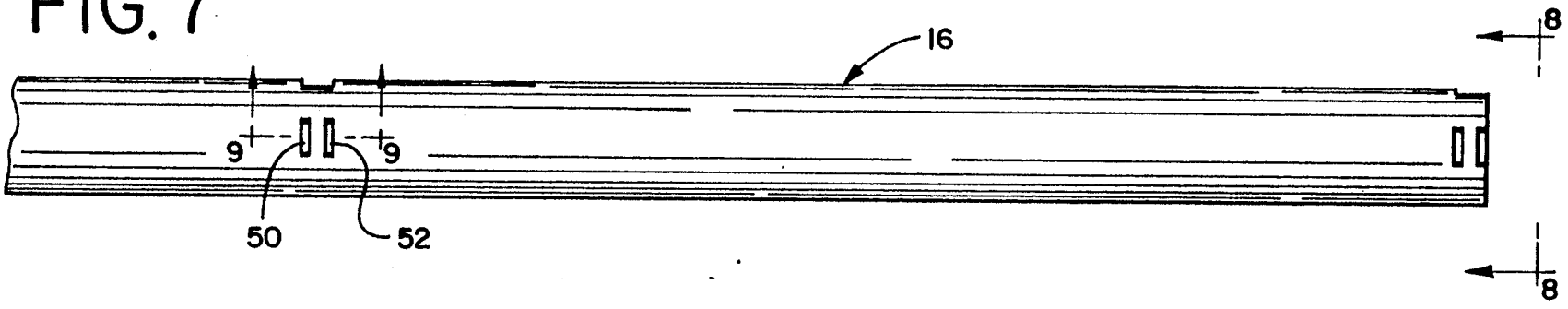
FIG. 7 is an elevational view of another form of fan blade.
Figure 8:
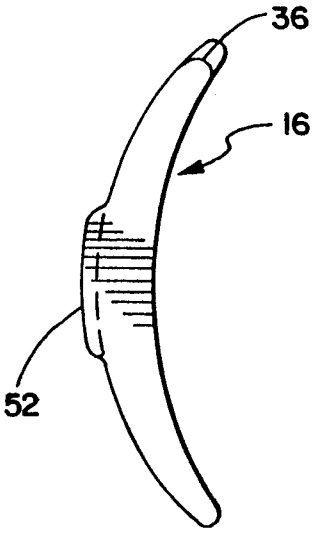
FIG. 8 is an enlarged end view of the fan blade illustrated in FIG. 7.
Figure 9:
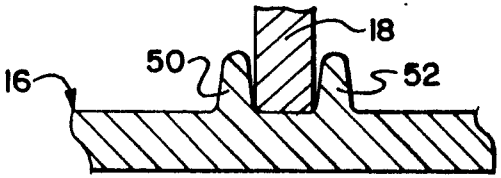
FIG. 9 is a fragmentary sectional view taken along line 9—9 of FIG. 7.

As shown in FIGS. 7, 8, and 9, and to enhance axial blade restraint, each blade further includes raised ridges 50 and 52 which are formed integral with the blade. The ridges 50 and 52 are arranged in axially spaced relation relative to each other to releasably entrap a disc 18 (FIG. 9) therebetween and thereby inhibiting unwarranted axial displacement of the blade relative to the disc.

As will be appreciated from the above, each fan blade 16 of the fan assembly is individually and releasably secured within a respective slot 22 on the discs 18 by the individual blade retaining means associated therewith. After freely inserting the blade 16 within the slot 22, the blade is twisted thereby causing the cantilevered arm 30 to resiliently deflect. Twisting the fan blade within the slat 22 causes the fan blade to move toward the terminal end of the arm 30. Ultimately, the recess 36 on the blade snaps into blade retaining notch 32 at the distal end of arm 30 thereby releasably and individually securing the blade 16 to the disc 16.

Another aspect of the present invention relates to a method of assembling in a transverse fan assembly. The method comprises the steps of: securing a plurality of discs 18 to an elongated shaft 14 in axially spaced relation to each other such that each slot 22 of a multiplicity of circumferentially and equally spaced slots are axially aligned relative to each other; providing individualized blade retaining means proximate to a first terminal end of each individual slot, wherein the retaining means extends generally toward a second terminal end of a respective slot and with the second terminal end of the slot being disposed on the discs in radially spaced relation to the first terminal end of the slot; inserting an elongated fan blade 16 through aligned slots in the discs 18; and twisting each fan blade within a respective slot until the fan blade is releasably and individually entrapped between the blade retaining means and the second terminal end of each slot under the influence of a substantially constant force individually directed against the fan blade by the blade retaining means.

With the present invention, each fan blade is individually secured to the disc 18. Thus, the design of the present invention allows for removal and replacement of individual fan blades, when required, without affecting other fan blades in the fan assembly. Moreover, each blade retainer 30 applies a substantially constant force against an individual blade in the array of fan blades comprising the fan assembly. During operation of the fan, if one fan blade breaks, only that fan blade will be affected. Moreover, when replacement of a fan blade is required, a reversing twisting action can be applied to the fan blade thereby releasing it from its engagement with the arm 30. As will be appreciated, releasing the fan blade from arm 30 does not affect the other blades in the fan assembly thus reducing down time and substantially reducing the number of different parts associated with the fan assembly.

From the foregoing, it will be observed that numerous modifications and variations can be effected without departing from the true spirit and scope of the novel concept of the present invention. It will be appreciated that the present disclosure is intended as an exemplification of the invention, and is not intended to limit the invention to the specific embodiment illustrated. The disclosure is intended to cover by the appended claims all such modifications as fall within the scope of the claims.

What is claimed is:

1. A transverse fan assembly comprising:

a central hub;

a plurality of elongated fan blades extending axially in a cylindrical pattern about said hub; and at least two disc shaped members connected to said hub, each disc shaped member defining a series of circumferentially and equally spaced slots corresponding in number to the plurality of blades arranged in a cylindrical pattern and configured to permit each fan blade to pass lengthwise through a respective disc shaped member; and blade retaining means for individually and releasably securing said fan blades to the respective disc shaped members, said blade retaining means comprising a series of resilient arms rotatable with each disc shaped member and corresponding in number to the number of slots in the respective disc shaped members, each arm of said blade retaining means is adapted to releasably engage and urge a respective fan blade radially outward away from said hub and against a stopping surface defined by the respective slot in the disc shaped member through which the blade passes in response to a twisting action of the blade within the slot thereby facilitating construction of said fan assembly and allowing for individual replacement of the fan blades without impacting upon other fan blades of the fan assembly.

2. The transverse fan assembly according to claim 1 wherein each of said fan blades includes means for restraining the fan blade against axial displacement relative to the disc shaped members during operation of the fan assembly.

3. The transverse fan assembly according to claim 1 wherein each of said disc shaped members is molded from a non-metallic material.

4. A transverse fan assembly comprising:

a plurality of elongated fan blades extending axially in a cylindrical pattern;

a plurality of axially spaced and generally aligned discs of substantially uniform diameter and attached to rotatable means for allowing said discs and fan blades to be rotated as an assembly about a fixed axis, each disc defining equidistantly spaced slots concentric with and inwardly of the disc periphery for allowing said fan blades to loosely pass therethrough;

each of said discs including blade retaining means for individually securing a fan blade to a respective disc and for allowing removal and replacement of individual fan blades when required without effecting other fan blades in the fan assembly, said blade retaining means including equidistantly spaced deflectable arms for engaging an inner edge of an resiliently biasing each fan blade radially outward against a stopping surface defined by the slot through which the fan blade passes in response to a twisting action being applied to the fan blade thereby releasably entrapping each fan blade between the arm of said blade retaining means and the stopping surface of said slot.

5. The transverse fan assembly according to claim 4 wherein each slot in the disc shaped members and the fan blade passing therethrough have an arcuate configuration.

6. The transverse fan assembly according to claim 4 wherein said plurality of axially spaced discs includes a pair of discs arranged toward opposite ends of the fan blades and a center disc arranged proximate midlength of the fan blades.

7. The transverse fan assembly according to claim 4 wherein said deflectable arms of said blade retaining means are formed as integral parts of each disc, and with each of said fan blades being made from a non-metallic material.

8. The fan assembly according to claim 4, each of said fan blades includes means for restraining the fan blade against axial displacement relative to a disc during operation of the fan assembly.

9. The fan assembly according to claim 8 wherein said restraining means includes recesses on opposite elongated edges of each fan blade such that when the fan blades are releasably secured to the discs registry is obtained between said recesses and said discs.

10. A transverse fan assembly for producing a wide and generally uniform air stream, said fan assembly comprising:

a central elongated shaft defining a rotational axis for said fan assembly;

a series of elongated fan blades extending axially in a generally cylindrical pattern about said shaft;

a series of discs of substantially uniform diameter secured to said shaft in axially spaced relation to each other, each of said discs having formed therein a multiplicity of circumferentially and equidistantly spaced fan blade mounting slots arranged inwardly of the disc periphery in concentric relationship relative to said shaft, with each blade mounting slot extending in a radial direction and having a closed configuration to radially and loosely contain fan blades between opposite ends thereof; and each disc further including blade retaining means for individually applying a substantially constant and radially directed force against an inner edge of the individual fan blades whereby urging the outer edge against an outer edge of the slot and thereby releasably securing each fan blade to a respective disc and permitting removal and replacement of individual fan blades without affecting adjacent fan blades, said blade retaining means including a multiplicity of deflectable arms with each arm projecting into a lower end of each mounting slot for resiliently and independently biasing a respective fan blade radially outward in response to application of a twisting action of the fan blade within the slot and for releasably entrapping each fan blade between a free end of said arm and the outer edge of the slot.

11. The fan assembly according to claim 10 wherein each of said blades is provided with recesses on opposite elongated edges thereof, each arm of said blade retaining means biasing a respective blade radially outward such that the recesses register with discs thereby inhibiting unwarranted axial displacement of the fan blade relative to the disc.

12. The fan assembly according to claim 10 wherein each fan blade has an arcuate configuration and each of said mounting slots has an arcuate surface complementary to said fan blades.

13. The fan assembly according to claim 10 further including means for restraining each fan blade against axial displacement relative to said discs during operation of the fan assembly.

14. The fan assembly according to claim 13 wherein each of said fan blades is formed from non-metallic material and said restraining means comprises raised ridges formed integral with said fan blade and arranged in axially spaced relation relative to each other to releasably entrap a disc therebetween to inhibit unwarranted axial displacement of the blade relative to the disc.

15. A method of assembling a transverse fan comprising the steps of:

securing a plurality of discs to an elongated shaft in axially spaced relation to each other and such that each slot of a multiplicity of circumferentially and equally spaced slots in the discs are axially aligned relative to each other;

providing blade retaining means proximate to a first terminal end of each individual slot, said blade retaining means including a series of cantilevered arms rotatable with said discs and extending within and generally toward a second terminal end of a respective slot with said second terminal end of said slot being disposed on said disc in radially spaced relation to the first terminal end of said slot;

inserting an elongated blade through aligned slots in said disc; and twisting each blade within a respective slot until said blade is releasably and individually entrapped between a free end of the respective arm of said blade retaining means extending within said slot and the second terminal end of said slot under the influence of a substantially constant radially directed force individually directed against the respective blade by said blade retaining means.

* * * * *